US010502383B2

(12) United States Patent
Uchida et al.

(10) Patent No.: US 10,502,383 B2
(45) Date of Patent: Dec. 10, 2019

(54) VEHICLE HEADLAMP

(71) Applicant: Koito Manufacturing Co., Ltd., Tokyo (JP)

(72) Inventors: Naoki Uchida, Shizuoka (JP); Honami Fujii, Shizuoka (JP); Kazuomi Murakami, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 16/166,440

(22) Filed: Oct. 22, 2018

(65) Prior Publication Data

US 2019/0145597 A1 May 16, 2019

(30) Foreign Application Priority Data

Oct. 25, 2017 (JP) ..... 2017-206001

(51) Int. Cl.

| | |
|---|---|
| ***F21V 21/00*** | (2006.01) |
| ***F21S 41/30*** | (2018.01) |
| ***F21S 41/176*** | (2018.01) |
| ***F21S 41/25*** | (2018.01) |

(52) U.S. Cl.

CPC ..... *F21S 41/30* (2018.01); *F21S 41/176* (2018.01); *F21S 41/25* (2018.01)

(58) Field of Classification Search

CPC ..... F21S 41/30; F21S 41/25; F21S 41/176

USPC ..... 362/514, 538

See application file for complete search history.

(56) References Cited

U.S. PATENT DOCUMENTS

| | | | | |
|---|---|---|---|---|
| 2015/0211703 | A1* | 7/2015 | Nakazawa | B60Q 1/085 362/514 |
| 2016/0341384 | A1* | 11/2016 | Hoshino | F21S 45/70 |
| 2017/0138555 | A1* | 5/2017 | Hirasawa | B60Q 1/14 |

FOREIGN PATENT DOCUMENTS

| | | | |
|---|---|---|---|
| EP | 3287692 | * | 2/2018 |
| EP | 3339919 | * | 6/2018 |
| JP | 2014-065499 A | | 4/2014 |

* cited by examiner

*Primary Examiner* — Laura K Tso

(74) *Attorney, Agent, or Firm* — Abelman, Frayne & Schwab

(57) ABSTRACT

A vehicle headlamp includes an excitation light source; a light deflector configured to receive light from the excitation light source and two-dimensionally scan the light received from the excitation light source; and a projection lens that transmits the light scanned by the light deflector. The vehicle headlamp includes a first auxiliary lens that is arranged between the light deflector and the projection lens so as to transmit the light scanned by the light deflector toward the projection lens, and the first auxiliary lens has a negative force.

8 Claims, 5 Drawing Sheets

VEHICLE HEADLAMP

CROSS-REFERENCE TO RELATED APPLICATIONS

This application is based on and claims priority from Japanese Patent Application No. 2017-206001, filed on Oct. 25, 2017, with the Japan Patent Office, the disclosure of which is incorporated herein in its entirety by reference.

TECHNICAL FIELD

The present disclosure relates to a vehicle headlamp in which a light stagnation dose not easily occur in a light distribution pattern formed by using a light deflector.

BACKGROUND

Japanese Patent Laid-Open Publication No. 2014-065499 discloses a vehicle headlamp that forms a light distribution pattern in front of a vehicle by scanning light emitted from a solid light source that generates LED lights or laser lights toward a phosphor having two types of phosphor layers while reflecting the light by a reflecting device that is a digital micro mirror device having a tiltable mirror, and transmitting the light that is reflected again inside the phosphor to an optical system (a projection lens).

SUMMARY

The reflecting device of the vehicle headlamp disclosed in, for example, Japanese Patent Laid-Open Publication No. 2014-065499 displays a drawing pattern in a predetermined shape on an object in front of a vehicle by reciprocatingly swinging light reflected from a solid light source with a swinging mirror at a high speed, and by repeatedly laminating the lines displayed in a swinging direction in a direction orthogonal to the swinging direction at a high speed while displacing by a minute distance.

At this time, the mirror in the reflecting device reciprocating in a predetermined reciprocating swinging area operates most quickly at a center position of reciprocating swinging, and gradually decelerates toward the two turning positions. In order to perform a turning operation in which the speed becomes 0 for a moment at the turning positions, that is, to perform a simple oscillation (vibration) at the turning positions, the light reflected by the mirror becomes the darkest at the center point where the moving distance becomes the longest, and becomes the brightest at the turning positions at the both end portions where the moving distance becomes the shortest.

Such a scanning light has a problem in that it causes a light stagnation phenomenon where both end portions of the light distribution pattern appear to be excessively bright as compared to the center portion.

Considering the problem described above, the present disclosure provides a vehicle headlamp in which light stagnation dose not easily occur in a light distribution pattern formed by using the light scanned by the light deflector.

A vehicle headlamp includes an excitation light source; a light deflector configured to scan the light of the excitation light source two-dimensionally; and a projection lens that transmits light scanned by the light deflector. The vehicle headlamp also includes a first auxiliary lens that is arranged between the light deflector and the projection lens so as to transmit the light scanned by the light deflector toward the projection lens, and the first auxiliary lens has a negative force.

(Action) The simple oscillating light scanned to reciprocate in the reciprocating swinging area constituted by two turning positions by the light deflector is incident on the first auxiliary lens having a negative force, so that the moving distance of the simple oscillating light becomes longer as it approaches to the turning positions.

The vehicle headlamp includes a second auxiliary lens that serves as a condensing lens having a positive force and arranged on a light path of the light of the excitation light source.

(Action) By performing a spot-condensing of the light scanned by the light deflector by using the second auxiliary lens, a shape distortion of the spot light which is scanned by transmitting through the first auxiliary lens is prevented and the contour of the light becomes clear.

In the vehicle headlamp, the light deflector includes a reflecting mirror that has a reflecting surface directed to both the excitation light source and the projection lens, and makes a reciprocating swinging rotation.

(Action) The simple oscillating light by the reflecting mirror that makes a reciprocating swinging rotation is transmitted through the first auxiliary lens, so that the moving distance of the light becomes longer as it approaches to the turning positions.

According to the vehicle headlamp of the present disclosure, since the moving distance becomes longer as approaching to the turning positions, the light stagnation hardly occur at the end portion of the light distribution pattern.

According to the vehicle headlamp of the present disclosure, the shape of the spot light of the scanning light is not collapsed and the contour thereof becomes clearer, so that the light distribution pattern becomes brighter and clearer.

According to the vehicle headlamp of the present disclosure, even when the reflecting mirror that makes a reciprocating swinging rotation is stopped for a moment at the turning positions, the light is transmitted through the first auxiliary lens, so that the light stagnation does not occur at the end portion of the light distribution pattern.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, embodiments of the present disclosure will be described based on FIGS. 1 to 5. In respective drawings, the directions of a road viewed from each of the components of the vehicle headlamp or a driver of a vehicle on which the vehicle headlamp is mounted are described as (upper:lower: left:right:front:rear=Up:Lo:Le:Ri:Fr:Re).

Figure 1:
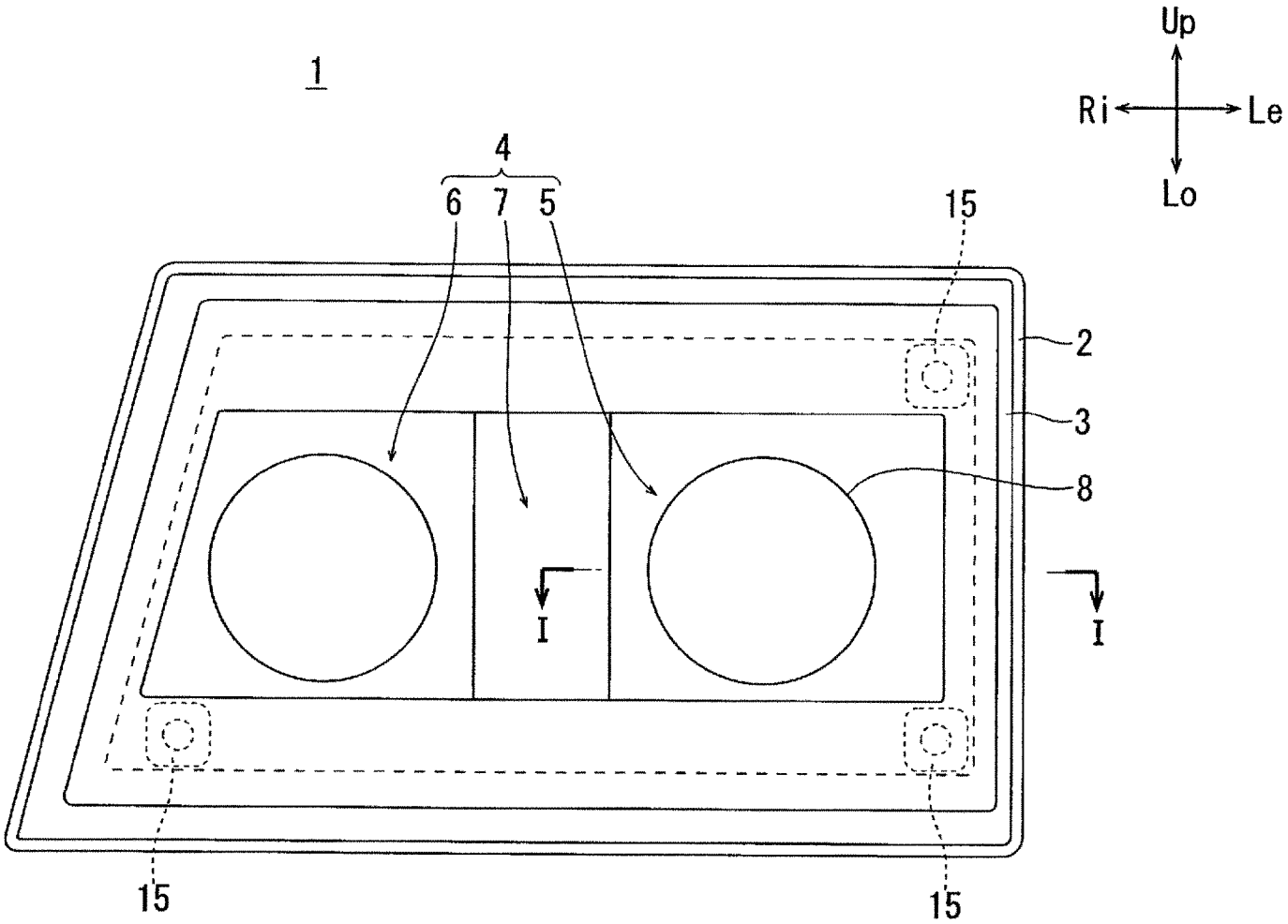
FIG. 1 is a front view illustrating a vehicle headlamp according to a first embodiment.

A vehicle headlamp of the first embodiment will be described with reference to FIGS. 1 to 4. A vehicle headlamp 1 of the first embodiment includes a lamp body 2, a front cover 3, and a headlamp unit 4. The lamp body includes an opening at a front side of a vehicle. The front cover 3 is formed of, for example, a resin or glass which has a light-transmitting property and forms a lamp chamber S by being attached to the opening of the lamp body 2. The headlamp unit 4 illustrated in FIG. 1 is formed by integrating a high-beam headlamp unit 5 and a low-beam headlamp unit 6 with a metallic support member 7, and is arranged inside the lamp chamber S.

Figure 2:
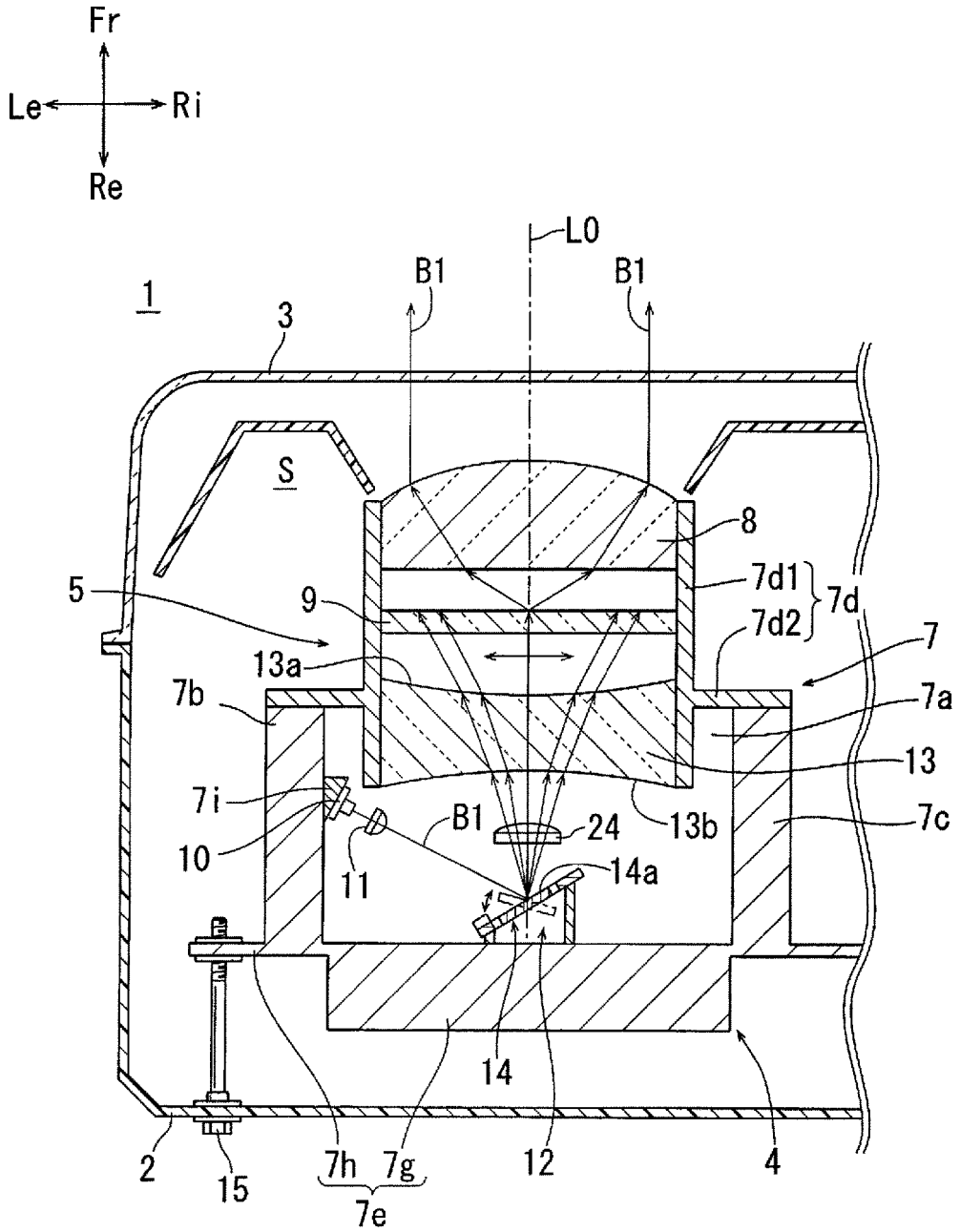
FIG. 2 is a cross-sectional view illustrating a high-beam lamp unit of the vehicle headlamp according to the first embodiment.

The high-beam headlamp unit 5 and the low-beam headlamp unit 6 respectively includes a projection lens 8, a phosphor 9, an excitation light source 10, a condensing lens 11, a light deflector 12, a first auxiliary lens 13, and a second auxiliary lens 24 as illustrated in FIG. 2, and all of them are attached to the support member 7.

The support member 7 in FIG. 2 is formed by a metal, and includes a bottom plate portion 7*a*, side plate portions 7*b* and 7*c* respectively integrated at the left end and the right end of the bottom plate portion 7*a*, a lens support portion 7*d* integrated with the distal ends of the side plate portions 7*b* and 7*c*, and a base plate portion 7*e* integrated with the distal ends of the side plate portions 7*b* and 7*c*. The lens support portion 7*d* is formed by a cylindrical portion 7*d*1 that holds the projection lens 8 therein, and a flange portion 7*d*2 that is formed on an outer periphery of a center portion of the cylindrical portion 7*d*1 and is integrated with both the cylindrical portion 7*d*1 and the side plate portions 7*b* and 7*c*. The base plate portion 7*e* is formed by a holding portion 7*g* of the light deflector 12 and screw fixing portions 7*h* formed to be extended to the right and left of the holding portion 7*g*.

The projection lens 8 in FIG. 2 is a plano-convex lens which is transparent or semi-transparent and becomes a convex shape toward the front side. The projection lens 8 is fixed inside the distal end portion of the cylindrical portion 7*d*1 of the lens support portion 7*d*. The phosphor 9 is formed in a disk shape and fixed inside the cylindrical portion 7*d*1 of the lens support portion 7*d* at the rear side of the projection lens 8.

The excitation light source 10 in FIG. 2 is formed by a blue or violet LED light source or a laser light source, and controlled to be turned ON/OFF by a controller (not illustrated). The excitation light source 10 is fixed to a light source support portion 7*i* provided on the side plate portion 7*d* at the left side of the support member 7 so that the heat generated during the turning ON of the light source is dissipated. The phosphor 9 is configured to generate the white light. When the excitation light source 10 is blue, the phosphor 9 is formed as a yellow phosphor. When the excitation light source 10 is violet, the phosphor 9 is formed as a yellow and blue phosphor, or as a phosphor having at least 3 colors of red, green, and blue (RGB).

The light deflector 12 in FIG. 2 is a scan device (a scanning mechanism) including a reflecting mirror 14 tiltable in a two axis directions, and is fixed to a front surface of the holding portion 7*g*. The condensing lens 11 is a transparent or semi-transparent plano-convex collimating lens having a convex surface as a light emitting surface, and is fixed to either one of the bottom plate portion 7*a* or the base plate portion 7*e* in a state of being arranged between the excitation light source 10 and a reflecting surface 14*a* of the reflecting mirror 14. The headlamp unit 4 is tiltably supported with respect to the lamp body 2 by a screw attaching three aiming screws 15 rotatably held by the lamp body 2 to the screw fixing portion 7*h* of the base plate portion 7*e* of the support member 7.

Figure 3:
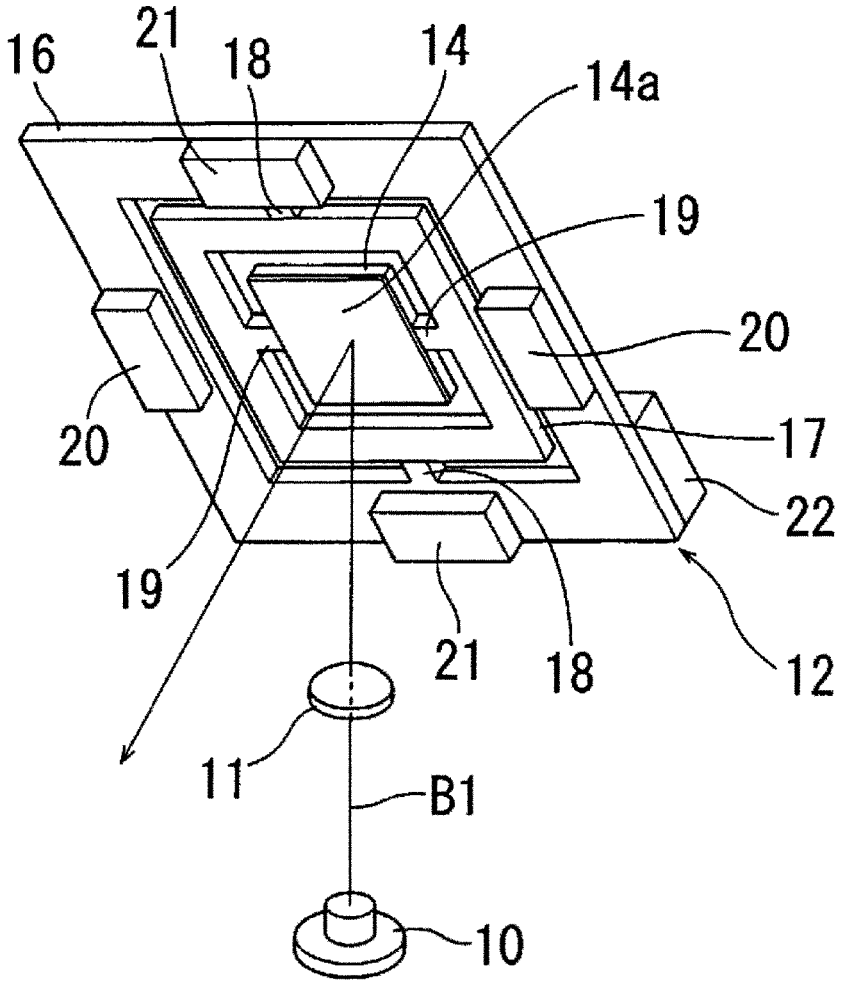
FIG. 3 is a perspective view illustrating a light deflector viewed from a front of an inclination of a reflecting mirror.

The light deflector 12 illustrated in FIG. 2 is formed by, for example, a MEMS mirror, and includes the reflecting mirror, a base 16, a rotating body 17, a pair of first torsion bars 18, a pair of second torsion bars 19, a pair of permanent magnets 20, a pair of permanent magnets 21, and a terminal portion 22 as illustrated in FIG. 3. The reflecting surface 14*a* is formed by performing processes such as a vapor deposition of silver or a plating to a front surface of the reflecting mirror 14.

The rotating body 17 which has a plate shape in FIG. 3 includes a first coil (not illustrated) that receives power supplied from the terminal portion 22, and is supported by the base 16 in a state of being tiltable in a left and right direction by a pair of the first torsion bars 18. The reflecting mirror 14 includes a second coil (not illustrated) that receives power supplied from the terminal portion 22, and is supported by the rotating body 17 in a state of being rotatable in a vertical direction by a pair of the second torsion bars 19. The rotating body 17 makes a reciprocating swinging rotation at a high speed in a left and right direction around an axis of the first torsion bar 18 by the first coil that is conductively controlled by a pair of the permanent magnets 20 and a control mechanism (not illustrated). The reflecting mirror 14 makes a reciprocating swinging rotation at a high speed in a vertical direction as well around an axis of the second torsion bar 19 by the second coil that is conductively controlled by a pair of the permanent magnets 21 and the control mechanism (not illustrated).

Figure 4:
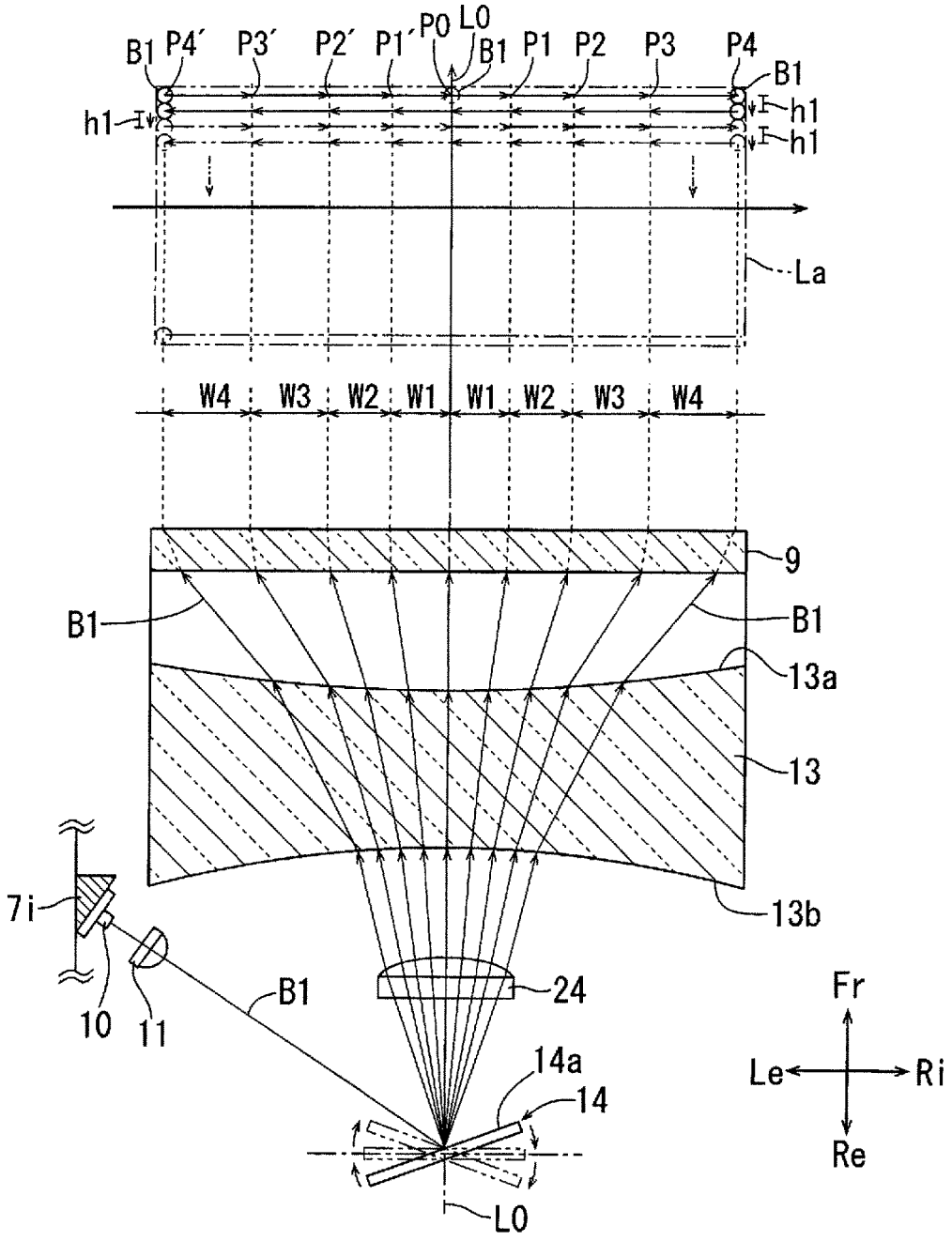
FIG. 4 is a view for explaining a light path and a light distribution pattern by a first auxiliary lens of the first embodiment.

The first auxiliary lens 13 is formed as a bi-concave lens having a concave light emitting portion 13*a* constituted by a concave aspherical surface facing the phosphor 9 and a concave light incident portion 13*b* constituted by a concave aspherical surface facing the reflecting mirror 14 around an axis L0, as illustrated in FIGS. 2 and 4. As an emitting position of the transmitted light from the first concave light emitting portion 13*a* moves away from the central axis L0, negative force is increased to increase diffusivity. The first auxiliary lens 13 is fixed inside a rear end portion of the cylindrical portion 7*d*1 of the lens support portion 7*d* in a state of being arranged in the rear of the phosphor 9. Both the concave light emitting portion 13*a* and the concave light incident portion 13*b* are formed to have a predetermined curvature.

Further, the second auxiliary lens 24 is a transparent or semi-transparent convex lens having a convex surface as a light emitting surface, exerts a plus force as a condensing lens, and is fixed to either one of the bottom plate portion 7*a* or the base plate portion 7*e* in a state of being arranged on a light path of a scanning light B1 that is swinging by the reflecting mirror 14 between the reflecting surface 14*a* of the reflecting mirror 14 and the concave light incident portion 13*b* of the first auxiliary lens 13. The second auxiliary lens 24 refracts the incident light B1 by the light deflector 12 in the axis line L0 direction and spot-condenses the light thereby preventing a collapsing of the shape of a light image of the spot light B1 which is transmitted through the first auxiliary lens 13 to be diffused and scanned, so that the contour becomes clear and the light distribution pattern becomes brighter and clearer. The second auxiliary lens 24 needs to be arranged on one of light paths of the light B1 by the excitation light source 10, and may be omitted by making the condensing lens 11 function as the second auxiliary lens 24.

As illustrated in FIG. 2, the light B1 by the excitation light source 10 is condensed toward the reflecting mirror 14 by the condensing lens 11, and reflected to the second auxiliary lens 24 by the reflecting surface 14*a* so as to be spot-condensed. The light B1 transmitted through the second auxiliary lens 24 is incident on the concave light incident portion 13*b* of the first auxiliary lens 13 and emitted from the concave light emitting portion 13*a* while being diffused. The light B1 then transmits the phosphor 9 and becomes the white light which is diffusing. Then, the light transmits through the projection lens 8 to become substantially parallel light that extends in a front and rear direction. The light is then emitted from the front cover 3 to the front side of the vehicle headlamp 1.

The light B1 is turned ON/OFF based on the conductive control of the excitation light source 10, scanned in a left and right direction at a high speed by the reflecting mirror 14 of the light deflector 12 to draw the white line having a length based on the turning ON/OFF that extends in a left and right direction at a predetermined position. And the scanning in the left and right direction is repeated at a high speed while shifting the vertical angle of the reflecting mirror 14 by a minute angle. Specifically, for example, as illustrated in FIG. 4, the light B1 is repeatedly scanned by the reflecting mirror 14 at a high speed in one of directions from the left to the right which spans from P4' which is a left-upper end portion of a scanned range to P4 which is a right-upper end portion of the scanned range via P0 while shifting downwardly by height h1, and a white light distribution pattern having a predetermined shape is displayed in the front side of a vehicle (not illustrated) by laminating the white lines which extends in the left and right direction in a vertical direction.

Next, with reference to FIG. 4, a light distribution pattern La displayed by the vehicle headlamp 1 of the first embodiment will be described in more detail. The light distribution pattern La of the first embodiment has the brightest portion at a center position and the darkest portion at the outer periphery position. In FIG. 4, for convenience of explanation, the projection lens 8 is omitted, and the light B1 after being incident on the phosphor 9 is assumed to be changed into a parallel light by the projection lens 8.

First, as illustrated in FIG. 4, the light deflector 12 of the first embodiment reciprocatingly swings the reflecting mirror 14 at a high speed in the left and right direction by the sine-wave driving. The reflecting mirror 14 reciprocatingly swinging by the sine-wave driving moves most quickly in the vicinity of the center position of the swinging, gradually decreases toward two turning positions, stops for a moment at the turning positions, and then performs a simple oscillating operation which accelerates again to the center position.

When the light B1 reflected in a radial direction from the reflecting surface 14*a* by the reflecting mirror 14 performing the simple oscillating operation is not transmitted through the first auxiliary lens 13 of FIG. 4, and instead, when the phosphor 9 is viewed from the front side by making the light B1 pass through a center of the first auxiliary lens 13 and making directly incident on the phosphor 9 which is orthogonal to a line L0 that extends in a front and rear direction, a moving distance per unit time of a light image due to the light B1 that swings in the left and right direction in the phosphor 9 becomes shorter as the light image moves away from the center position of the reciprocating swinging toward the turning position, thereby the light distribution pattern displayed by scanning such light image becomes the darkest at the center where the moving distance of the light image is the longest. As the moving distance decreases, the light distribution pattern becomes brighter, there is a problem that a light stagnation occurs on the outer periphery of the light distribution pattern corresponding to the two turning positions of the moving light image.

The first auxiliary lens 13 of the present embodiment illustrated in FIGS. 2 and 4 transmits the light directed from the reflecting mirror 14 that performs a simple oscillating operation toward the phosphor. Therefore, the moving distance per unit time becomes longer as the scanning light B1 reciprocatingly swinging in the phosphor 9 moves away from the center position of the reciprocating swinging toward the two turning positions. As a result, the problem related to the light stagnation is solved by making the outer periphery of the light distribution pattern La to be the darkest, and the center thereof is made to be the brightest so that the center becomes a hot spot.

First, when the reflecting mirror 14 in FIG. 4 is rotated from the front (an arrangement of the reflecting surface 14*a* in which the light B1 travels straight on the axis L0) to the right side for a predetermined time t, the scanning light B1 is incident onto the first auxiliary lens 13 that is a biconcave lens, is refracted to be diffused in the right direction, and moves a distance W1 in the right direction from P0 to P1 in the phosphor 9. Every time the reflecting mirror 14 is rotated again in the right direction for the same predetermined time t, the scanning light B1 moves a distance W2 from P1 to P2, a distance W3 from P2 to P3, and a distance W4 from P3 to P4 that is the turning position on the right side in the phosphor 9 in this order.

The first auxiliary lens 13 is a biconcave lens having the concave light emitting portion 13*a* and the concave light incident portion 13*b* which are aspheric surfaces on the front and rear surfaces. Thus, the degree of diffusing of the scanning light B1 emitted from the concave light emitting portion 13*a* of the first auxiliary lens 13 is increased as the emitting position becomes away from the central axis L0 of the first auxiliary lens 13 which is a center point P0 of the reciprocating swinging position. Therefore, a relationship of the moving distances per a predetermined time t of the scanning light B1 that move in the phosphor 9 is $W1<W2<W3<W4$. Thus, the right half of the light distribution pattern La becomes the darkest in the vicinity of the right end, so that the light stagnation is eliminated, and the center becomes the brightest to be a hot spot.

This is also applied to a case where the reflecting mirror 14 that reflects the light B1 is rotated from the front to the left side. The first auxiliary lens 13 has a symmetrical shape about the center axis L0, thereby the moving distance of the light B1 increases as the light moves from the center of the swinging range to the turning position on the left side. When the reflecting mirror 14 is rotated from the front (a direction along the axis L0) to the left side for the predetermined time t, the scanning light B1 is refracted to be diffused in the left direction by the first auxiliary lens 13 that is a biconcave lens, and moves a distance W1 in the right direction from P0 which is the front position to P1' in the phosphor 9. Every time the reflecting mirror 14 is rotated again in the left direction for the same predetermined time t, the scanning light B1 moves a distance W2 from P1' to P2', a distance W3 from P2' to P3', and a distance W4 from P3' to P4' that is the turning position on the left side in the phosphor 9 in this order. Therefore, the left half of the light distribution pattern La also becomes the darkest in the vicinity of the left end, so that the light stagnation is eliminated, and the center becomes the brightest to be a hot spot.

As a result, the light B1 is repeatedly scanned in the left and right direction between P4' to P4 at a high speed while shifting downward by a minute height h1 as illustrated in FIG. 4, and displays the white light distribution pattern La having a predetermined shape in which the center is the brightest and the brightness becomes gradually darker toward the outer periphery.

Figure 5:
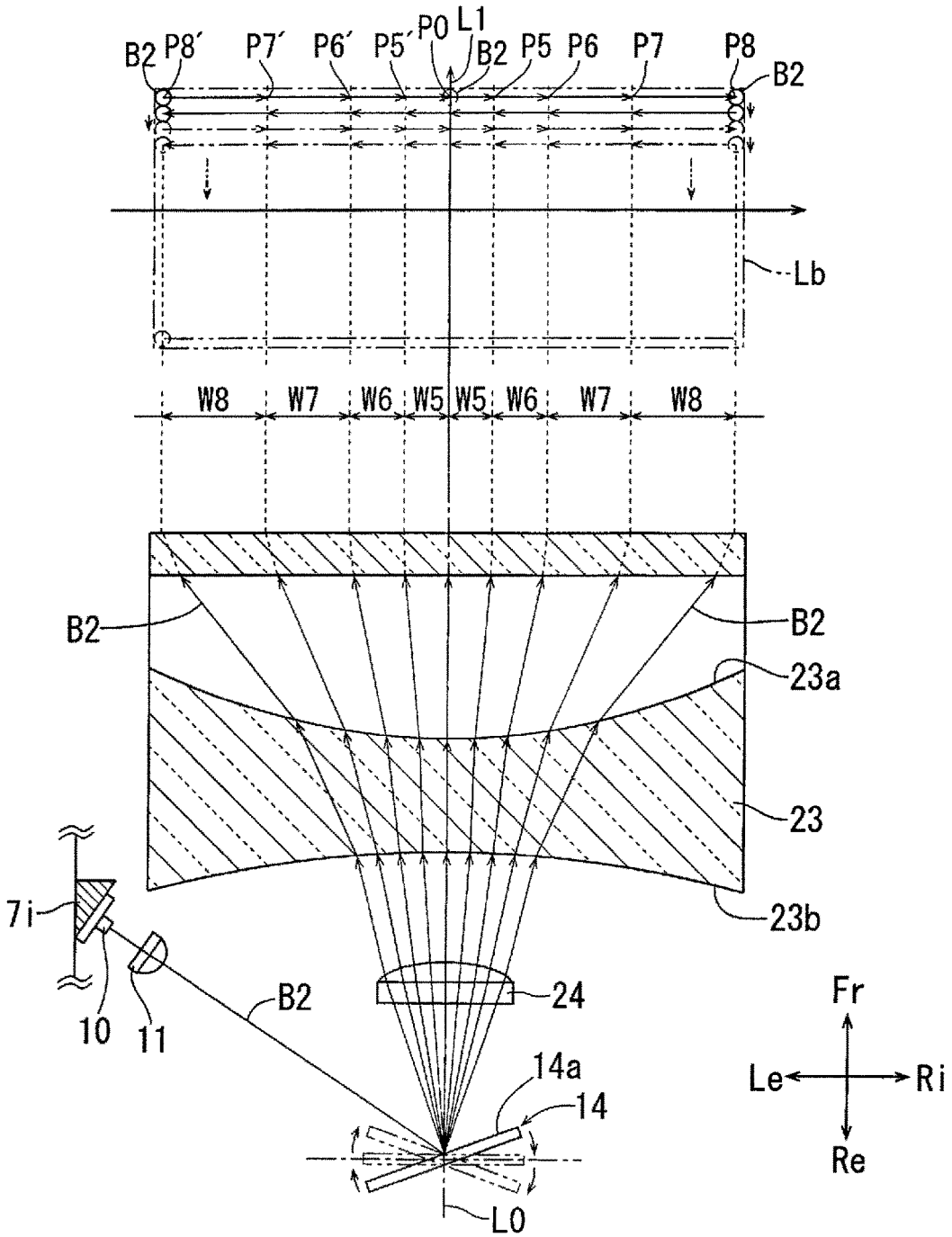
FIG. 5 is a view for explaining a light path and a light distribution pattern by a first auxiliary lens of a second embodiment.

Next, with reference to FIG. 5, an auxiliary lens 23 of a second embodiment that is an improvement of the first auxiliary lens 13 of the first embodiment will be described. The first auxiliary lens 23 is used instead of the first auxiliary lens 13 in the vehicle headlamp 1 of the first embodiment, and displays a light distribution pattern Lb in which the center position is brighter and the outer periphery is darker. In FIG. 5, for convenience of explanation, the projection lens 8 is omitted, and the light B2 after being incident onto the phosphor 9 is assumed to be changed into a parallel light by the projection lens.

The first auxiliary lens 23 illustrated in FIG. 5 is formed as a bi-concave lens having a concave light emitting portion 23*a* constituted by a concave aspherical surface facing the phosphor 9 and a concave light incident portion 23*b* constituted by a concave aspherical surface facing the reflecting mirror 14 around an axis L1. As an emitting position of the transmitted light from the first concave light emitting portion 13*a* moves away from the central axis L1, a negative force is increased to increase the diffusivity of the light. The first auxiliary lens 23 is common to the first auxiliary lens 13 of the first embodiment illustrated in FIG. 4 in that both lenses are biconcave lenses. However, first auxiliary lens 23 is different from the first auxiliary lens 13 in that the curvature of the concave shape emitting portion 23*a* is larger than that of the concave shape incident portion 13*a* of the first embodiment. In the present embodiment, it is assumed that the curvature of the concave shape incident portion 23*b* is the same as that of the concave shape incident portion 13*b* of the first embodiment.

The excitation light source 10, the condensing lens 11, and the light deflector 12 have the same configuration as in the first embodiment, and the reflecting mirror 14 of the light deflector 12 is reciprocatingly swinging at a high speed in the left and right direction at a predetermined constant angular speed as in the first embodiment. Further, the light emitted from the excitation light source 10 in FIG. 5 is assumed to be light B2.

Every time the reflecting mirror 14 is rotated from the front (a direction along the axis L1) to the right side for a predetermined time t, the scanning light B2 illustrated in FIG. 5 moves a distance W5 from P0 that is the front position to P5, a distance W6 from P5 to P6, a distance W7 from P6 to P7, and a distance W8 from P7 to P8 that is the turning position on the right side in the phosphor 9 in this order. And every time the reflecting mirror 14 is rotated from the front to the left side for the predetermined time t, the scanning light B2 moves the distance W5 from P0 to P5', the distance W6 from P5' to P6', the distance W7 from P6' to P7', and the distance W8 from P7' to P8' that is the turning position on the left side in the phosphor 9 in this order.

The scanning light B2 illustrated in FIG. 5 transmits through the first auxiliary lens 23 and a degree of diffusing is increased as the emitting position of the concave light emitting portion 23*a* is away from the central axis L1 of the first auxiliary lens 23. As a result, the scanning light B2 is not much different from the scanning light B1. Therefore, the moving distance of the scanning light B2 in the phosphor 9 per a predetermined time t is common to the scanning light B1 of the first embodiment to have a relationship of W5<W6<W7<W8 in that the moving distance increases as the light approaches to the turning positions on the left side and the right side from the front position P0 that is a center of the swinging.

Meanwhile, as illustrated in FIGS. 4 and 5, an increasing rate of the moving distance of the scanning light B2, which increases as the light approaches to the turning positions on the left side and the right side from the front position P0 that is a center of the swinging, is larger than that of the first auxiliary lens 13 of the first embodiment by the fact that the curvature of the concave light emitting portion 23*a* of the first auxiliary lens 23 is formed larger than the curvature of the concave light emitting portion 13*a* of the first auxiliary lens 13 of the first embodiment. Therefore, the relationships of the moving distance of the scanning light B2 with respect to the moving distance of the scanning light Blare W5<W1 and W8>W4. As a result, in the light distribution pattern Lb in FIG. 5, the center which becomes a hot spot is brighter and the outer periphery is darker as compared to the light distribution pattern La in FIG. 4, so that the first auxiliary lens 23 of the second embodiment may be preferable to the first auxiliary lens 13 of the first embodiment in that the light stagnation is further reduced in the second embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A vehicle headlamp comprising:

an excitation light source;

a light deflector configured to receive light from the excitation light source and two-dimensionally scan the light received from the excitation light source;

a projection lens that transmits the light scanned by the light deflector;

a first auxiliary lens arranged between the light deflector and the projection lens; and a phosphor arranged between the first auxiliary lens and the projection lens, the phosphor configured to generate and transmit white light directly to the projection lens, wherein the first auxiliary lens is configured to transmit the light scanned by the light deflector toward the projection lens, and the first auxiliary lens has a negative power.

2. The vehicle headlamp according to claim 1, further comprising a second auxiliary lens arranged between the light reflector and the first auxiliary lens, the second auxiliary lens configured to exert a positive power as a condensing lens arranged on a light path of the light of the excitation light source.

3. The vehicle headlamp according to claim 1, wherein the light deflector includes a reflecting surface that is directed to both the excitation light source and the projection lens, the light deflector being fixed to a reflecting mirror that makes a reciprocating swinging rotation.

4. The vehicle headlamp according to claim 2, wherein the light deflector includes a reflecting surface that is directed to both the excitation light source and the projection lens, the light deflector being fixed to a reflecting mirror that makes a reciprocating swinging rotation.

5. The vehicle headlamp according to claim 1, further comprising a condensing lens arranged between the light excitation light source and the light reflector, the condensing lens configured to condense the light of the excitation light source toward the light reflector.

6. The vehicle headlamp according to claim 2, further comprising a condensing lens arranged between the light excitation light source and the light reflector, the condensing lens configured to condense the light of the excitation light source toward the light reflector.

7. The vehicle headlamp according to claim 2, wherein the light deflector is configured to direct light of the excitation light source directly to the second auxiliary lens.

8. The vehicle headlamp according to claim 7, wherein the second auxiliary lens is configured to direct light scanned by the light deflector directly to the first auxiliary lens.

* * * * *